US006748678B2

(12) United States Patent
Verseef

(10) Patent No.: US 6,748,678 B2
(45) Date of Patent: Jun. 15, 2004

(54) SNOW REMOVAL APPARATUS AND METHOD

(75) Inventor: Jan Verseef, Heiloo (NL)

(73) Assignee: Schmidt Engineering and Equipment, Inc., New Berlin, WI (US)

( * ) Notice: Subject to any disclaimer, the term of this patent is extended or adjusted under 35 U.S.C. 154(b) by 0 days.

(21) Appl. No.: 10/167,998

(22) Filed: Jun. 12, 2002

(65) Prior Publication Data

US 2003/0230008 A1 Dec. 18, 2003

(51) Int. Cl.[7] ..... E01H 8/02; E01H 5/07; A13C 19/10

(52) U.S. Cl. ..... 37/208; 37/219; 37/237; 37/389; 37/391; 37/464

(58) Field of Search ..... 37/208, 232, 237, 37/240, 241, 233, 219, 389, 391, 392, 462–464; 15/80, 223

(56) References Cited

U.S. PATENT DOCUMENTS

| | | | | | |
|---|---|---|---|---|---|
| 294,084 | A | * | 2/1884 | Schulze | 104/279 |
| ,446,326 | A | | 2/1891 | Chambers | |
| 509,303 | A | * | 11/1893 | Fisher | 15/80 |
| 977,724 | A | * | 12/1910 | Friedman | 37/228 |
| 1,147,122 | A | * | 7/1915 | Scheiden | 37/208 |
| 1,202,062 | A | | 10/1916 | Hedley et al. | |
| 1,396,846 | A | | 11/1921 | Jezova | |
| 1,462,901 | A | * | 7/1923 | Brecht | 37/238 |
| 1,534,611 | A | * | 4/1925 | Schmidt | 37/244 |
| 1,560,612 | A | * | 11/1925 | Sims | 15/347 |
| 1,645,837 | A | | 10/1927 | Wadsworth | |
| 1,816,389 | A | * | 7/1931 | Moberg | 172/33 |
| 1,999,226 | A | * | 4/1935 | Wold | 172/785 |
| 2,055,840 | A | * | 9/1936 | Girard | 37/228 |
| 2,095,096 | A | | 10/1937 | Humphrey | |
| 2,355,160 | A | * | 8/1944 | Hodsdon | 37/240 |
| 2,768,454 | A | * | 10/1956 | Schmeche | 37/240 |
| 2,825,985 | A | | 3/1958 | Weeks | |
| 2,847,770 | A | * | 8/1958 | Wright | 37/240 |
| 2,870,469 | A | | 1/1959 | Meece | |
| 3,028,692 | A | | 4/1962 | Brock | |
| 3,156,937 | A | * | 11/1964 | Weir | 15/80 |
| 3,231,991 | A | | 2/1966 | Wendscheer et al. | |
| 3,279,104 | A | | 10/1966 | Wendscheer et al. | |
| 3,598,186 | A | | 8/1971 | Coontz | |
| 3,659,363 | A | | 5/1972 | Snyder | |
| 3,744,568 | A | * | 7/1973 | Beyers et al. | 172/33 |
| 3,762,077 | A | | 10/1973 | Henry et al. | |
| 3,772,803 | A | | 11/1973 | Cote | |
| 3,777,822 | A | * | 12/1973 | Stedman et al. | 172/33 |
| 3,924,285 | A | * | 12/1975 | Hukuba | 15/49.1 |
| 4,077,139 | A | | 3/1978 | Fagervold et al. | |
| 4,079,791 | A | | 3/1978 | Yoder et al. | |
| 4,249,323 | A | | 2/1981 | Mathis et al. | |
| 4,356,645 | A | | 11/1982 | Hine et al. | |
| 4,357,766 | A | | 11/1982 | Croteau et al. | |
| 4,429,433 | A | * | 2/1984 | Burgoon | 15/320 |
| 4,457,036 | A | * | 7/1984 | Carlson et al. | 15/49.1 |
| 4,552,226 | A | | 11/1985 | Platter | |

(List continued on next page.)

FOREIGN PATENT DOCUMENTS

| | | | |
|---|---|---|---|
| DE | 2519112 | | 11/1976 |
| DE | 2617235 | | 10/1977 |
| DE | 3928914 A1 | * | 3/1991 |
| JP | 1-190805 | * | 7/1989 |
| WO | 89/01546 | * | 2/1989 |

*Primary Examiner*—Thomas B. Will
*Assistant Examiner*—Thomas A Beach
(74) *Attorney, Agent, or Firm*—Michael Best & Friedrich LLP

(57) ABSTRACT

An apparatus and a method for removing snow, including a conveyor mounted at an angle with respect to a travel direction of the apparatus. The conveyor is rotatably mounted to a frame and can be driven to throw snow laterally with respect to a travel direction of the vehicle to which the apparatus is mounted.

29 Claims, 4 Drawing Sheets

U.S. PATENT DOCUMENTS 4,568,028 A 2/1986 Verseef et al.
4,669,205 A 6/1987 Smathers
4,685,228 A * 8/1987 Gisler et al. ..... 37/197
4,727,665 A 3/1988 Verseef
4,741,116 A 5/1988 Engle et al.
4,760,657 A * 8/1988 Ganzmann et al. ..... 37/232
4,827,637 A * 5/1989 Kahlbacher ..... 37/237
4,837,951 A 6/1989 Verseef
5,025,577 A 6/1991 Verseef
5,048,207 A 9/1991 Verseef
5,191,729 A 3/1993 Verseef
5,239,720 A * 8/1993 Wood et al. ..... 15/4
5,638,618 A 6/1997 Niemela et al.
5,655,318 A 8/1997 Daniels
5,697,172 A 12/1997 Verseef
5,743,032 A 4/1998 Vauhkonen
5,794,710 A * 8/1998 Maxwell ..... 172/33
5,797,203 A * 8/1998 Vanderlinden ..... 37/227
5,819,444 A 10/1998 Desmarais
5,829,174 A 11/1998 Hadler et al.
5,894,689 A 4/1999 Turk
5,899,007 A 5/1999 Niemela et al.
6,044,579 A 4/2000 Hadler et al.
6,085,445 A * 7/2000 Kanzler ..... 37/222
6,154,986 A 12/2000 Hadler et al.
6,523,620 B1 2/2003 Burson

* cited by examiner

SNOW REMOVAL APPARATUS AND METHOD

FIELD OF THE INVENTION

The present invention relates generally to apparatuses and methods for moving snow, and more particularly to apparatuses and methods for removing snow from travel surfaces.

BACKGROUND OF THE INVENTION

In the snow removal industry, snow is ordinarily removed from travel surfaces such as roads, runways, driveways, bridges, parking lots, and the like for purposes of safety and improved user travel. Generally, snow is removed with a snowplow, a shovel, a blower, a broom, an auger, an air blower, or a combination thereof Despite numerous developments in snow removal technology, several problems still exist with conventional snow removal apparatuses and methods.

There is a need for a snow removal apparatus which can remove snow from obstructions and discontinuities in the travel surface. Travel surfaces often have features such as potholes, cracks, speed bumps, manhole covers, storm drains, rumble-strips, or other similar obstructions and discontinuities. Plows and other conventional snow removal apparatuses are frequently unable to remove snow from such features in the travel surface. The snow left in these areas can cause slippery spots on the travel surface, making the travel surface unsafe even after a snow removal apparatus has removed most of the snow. Additionally, snow which accumulates in these areas can contribute to the deterioration of the travel surface. Specifically, this snow can melt and seep into the travel surface, later expanding and contracting as the resulting water alternately freezes and thaws.

There is also a need for a snow removal apparatus which can remove snow from a travel surface with varying cross-sectional elevations. For example, travel surfaces such as roads and runways are often sloped or provided with a crown having a high central elevation and lower outer edges. Generally, the wider the travel surface, the larger the difference between such elevations. Alternatively, travel surfaces can slope inwardly from high outer edges to a central depressed gutter. This type of travel surface shape can serve a number of different purposes, such as to facilitate drainage down the center of the travel surface or to prevent pooling of melted snow, rainwater, runoff, waste, and the like.

Additionally, it is often necessary to remove all or nearly all of the snow from a travel surface. Some travel surfaces (e.g., airport runways and freeways) cannot be used or are dangerous to use unless snow is entirely or nearly entirely removed from the travel surface prior to use. In these applications it may not be sufficient to remove most of the snow from a travel surface, leaving patches of missed snow. These areas of missed snow can be highly dangerous and/or unacceptable and can cause slippery spots on the travel surface. Therefore, airports, freeways, and other similar facilities can be subject to shut-down until snow is entirely or nearly entirely removed from the travel surface. In these cases, delays in removing snow from the travel surface can cost the owners, operators, users, and customers of the travel surfaces significant amounts of lost time and/or money. It is therefore highly desirable to have a snow removal apparatus capable of removing all or nearly all snow from a travel surface or from a given area of a travel surface.

Conventional snow removal apparatuses generally remove snow relatively well from areas of the travel surface having the highest elevations. However, conventional snow removal apparatuses generally leave snow on areas of the travel surface having the lowest elevations. In applications in which it is particularly necessary to remove snow from crowned or centrally-depressed travel surfaces (e.g., freeways, highways, airport runways, and taxiways), conventional snow removal apparatuses must often make several passes to remove all or nearly all snow from the travel surface. Alternatively, multiple vehicles are needed to clear snow from the travel surface. Often, even after multiple passes have been made with conventional snow removal apparatuses, snow still remains in areas having the lowest elevations. Therefore, a need exists for a snow removal apparatus capable of removing snow from a travel surface having a varying cross-sectional elevation without necessitating numerous passes and without missing significant quantities of snow.

The speed with which a snow removal apparatus removes snow from a travel surface is also an important consideration. Removal of snow is generally a relatively labor intensive operation, and can therefore be fairly expensive and can require skilled operators for satisfactory results.

The durability of snow removal apparatuses is also an important design consideration. Snow removal apparatuses are often used in relatively extreme conditions. Also, because snow and/or darkness often conceals obstructions, discontinuities, and other features on a travel surface, it is desirable that the snow removal system be resilient enough to overcome these surface features without sustaining damage, causing damage to the connected vehicle or damaging the travel surface. To overcome hidden obstructions, discontinuities, and other features on travel surfaces, conventional snow removal apparatuses are often designed to jump or trip over such features. Unfortunately, the snow removal apparatus later returns to the travel surface having missed some snow and having permitted escape of snow beneath the blade. Additionally, the snow removal apparatus often jumps or bounces relatively high and then crashes down onto the travel surface, possibly damaging the snow removal apparatus, the vehicle to which the snow removal apparatus is attached, and/or the travel surface. Therefore, a snow removal apparatus is needed which can overcome these surface features without missing snow and without causing damage to the snow removal apparatus, the attached vehicle, or the travel surface.

Snow removal apparatuses that can be relatively easily mounted on and removed from vehicles V are highly desirable. In the snow removal industry, it is often necessary to remove snow removal apparatuses from vehicles when snowfall is unlikely or when the vehicle is needed for other operations. This need to remove or remount a snow removal apparatus on a vehicle occurs relatively frequently. In some cases, governments, municipalities, contractors, and owner-operators often use the same vehicles for snow removal and for other unrelated operations such as waste hauling and transportation of soil, gravel, and the like. For example, snowplows are often coupled to garbage trucks, dump trucks, and the like. Municipalities and contracting companies often employ these and other types of vehicles for multiple purposes (including snow removal). When these vehicles are not removing snow, it can be desirable to remove the snow removal apparatus from the vehicle to preserve the snow removal apparatus and to reduce the weight of the vehicle. Similarly, when snowfall does occur, it is often necessary to remount the snow removal apparatuses onto vehicles as rapidly as possible. It is therefore desirable to be able to remove the snow removal apparatus from a vehicle and to remount the snow removal apparatus on the vehicle relatively rapidly and relatively easily.

A snow removal apparatus that can throw snow relatively far from a travel surface is also highly desirable. It is highly desirable to throw snow away from the travel surface to prevent the snow from blowing or drifting back onto cleared areas. Additionally, snow piled immediately adjacent travel surfaces can pile up and reduce visibility, making corners and intersections particularly dangerous.

Conventional snow removal apparatuses are often unable to remove snow from unpaved or partially paved surfaces without damaging the travel surface. This is particularly true in applications in which the travel surface is not paved and/or is covered with organic material or with gravel (e.g., gravel driveways, athletic fields, hiking or biking trails, ice skating surfaces, railroad tracks, etc.). Conventional snow removal apparatuses such as snowplows often remove some or all of the organic ground cover and/or gravel along with the snow, thereby wearing away or damaging the travel surface.

In addition to the above mentioned design considerations, snow removal apparatuses that are durable, easy to manufacture, easy to assemble, and inexpensive are highly desirable for obvious reasons. In light of the above design requirements and limitations, a need exists for a snow removal system and method for removing alternatively relatively large or small quantities of snow from a travel surface, which causes minimal to no damage to the travel surface during snow removal, is capable of moving snow relatively rapidly, and can be contoured to overcome obstructions, discontinuities, and other features on the travel surface. Each preferred embodiment of the present invention achieves one or more of these results.

SUMMARY OF THE INVENTION

The present invention employs a number of features addressing the problems shared by conventional snow removal apparatuses and methods. The snow removal apparatus of the present invention is preferably moveable along a travel surface in a travel direction and is operable to remove snow from the travel surface by rotating a belt, a chain, a brush, or other conveyor about an axis to remove snow from the travel surface and to throw the snow at an angle relative to the travel direction.

The snow removal apparatus can be coupled to a vehicle in any number of different locations using any number of mounting structures and methods. For example, the snow removal apparatus can be coupled to the underside of the vehicle, between axles of the vehicle, to the front of the vehicle, to the back of the vehicle, to one side of the vehicle, or can be towed behind the vehicle. However, in some highly preferred embodiments, the snow removal apparatus is coupled to the underside of the vehicle relatively near the travel surface.

The present invention preferably includes a frame coupled to a vehicle, a drive mechanism having a first axle coupled to the frame and defining a first axis, a second axle coupled to the frame and defining a second axis, and a conveyor extending about the first and second axles for rotation about the axles.

The frame is preferably a relatively rigid structure and is preferably removably coupled to the vehicle (e.g., the underside of the vehicle). Alternatively, the frame can include wheels, treads, tracks, skis, or other similar members to support the snow removal apparatus for operation independent from or in conjunction with the vehicle.

The first and second axles are preferably relatively elongated members such as shafts, bars, shanks, rollers, and the like. Alternatively, the first and second axles can be relatively shorter and can be defined by two or more longitudinally spaced members. In either case, the axles either define elements about which the conveyor rotates or (more preferably) rotatable support wheels about which the conveyor rotates. In this regard, the term "wheel" refers to any rotatable elements functioning like a wheel about which the conveyor can pass, including without limitation pulleys, gears, discs, sprockets, and the like. The first and second axles and/or the wheels thereon are adapted to rotate with respect to the frame and about the first and second axes, respectively. In some preferred embodiments, the first and second axles are rotatably coupled to the frame so that they can each rotate independently of the frame and can support the conveyor. The first and second axles can be (but are not necessarily) the same size and shape, substantially parallel to one another, and at relatively equal distances from the travel surface during operation of the snow removal apparatus.

The conveyor is preferably a single loop-shaped element. In some preferred embodiments of the present invention, the conveyor is a belt. In other embodiments, the conveyor can be a number of individual elements coupled or linked together to define a loop. For example, the belt can be a chain, a series of connected slats, or another similarly configured structure. The conveyor preferably extends about or past one or more driving wheels or other driving members for driving the conveyor. The driving wheels or other driving members can be the axles (or wheels thereon), which are driven in any manner desired. In such cases, either or both axles can be driven to cause the conveyor to rotate.

The conveyor preferably has a first and a second side (e.g., defining an inner surface and outer surface). At least part of the first side of the conveyor is preferably in contact with the first and second axles as the conveyor travels about the axles. The second side of the conveyor faces the travel surface as the conveyor rotates about the axles.

A plurality of bristles are preferably located on the second side of the conveyor. Preferably, the bristles are distributed across the second side of the conveyor, such as in an evenly or patterned distribution across the second side of the conveyor. Also preferably, the bristles are positioned on the conveyor so that they stand up and extend away from the conveyor. In this manner, the bristles can be dragged through snow by the conveyor, can drag a quantity of snow from the travel surface to one side of the snow removal apparatus, and can throw the snow away from the travel surface.

In some embodiments, the first axle is driven by a prime mover. The prime mover preferably transmits driving force to the first axle directly or indirectly (e.g., through one or more gears, drive belts, chain drives, or other elements and assemblies). The prime mover preferably drives the first axle about the first axis, which in turn causes the second axle to rotate about the second axis. In alternative embodiments of the present invention, the second axle can be driven directly or indirectly by the prime mover or another prime mover in addition to or instead of the first axle.

In some preferred embodiments of the present invention, an elevator is coupled to the frame and to the vehicle. The elevator can selectively raise and lower the snow removal apparatus with respect to the travel surface. In this manner, the elevator can lift the snow removal apparatus off of the travel surface so that a clearance exists between the snow removal apparatus and the travel surface. This is particularly useful for transportation of the snow removal apparatus to and from a work site. Similarly, the elevator can lift the snow removal apparatus over obstructions. Also, the snow removal apparatus can be lowered toward the travel surface in order to more fully engage the travel surface. In some highly preferred embodiments of the present invention, the elevator can also or instead be used to attach the snow removal apparatus to the vehicle. For example, the elevator can be used in attaching and/or detaching the snow removal apparatus (e.g., the frame of the snow removal apparatus) to the vehicle.

Some embodiments of the present invention are employed on vehicles having a snowplow. By way of example only, a snowplow can be coupled to the front of the vehicle while the conveyor is preferably coupled to the underside of the vehicle as mentioned above. Alternatively, the snowplow can be coupled to the side of the vehicle with the snow removal apparatus coupled to the front or side of the vehicle.

In these and other preferred embodiments of the present invention, the snow removal apparatus is employed on a vehicle having a blower. Preferably, the blower is positioned on the vehicle to direct air, oxygen, antifreeze, or other fluid onto the travel surface to blow snow off of the travel surface or to deposit material on the travel surface. Additionally, the blower can blow a relatively hot fluid onto the travel surface for melting snow so that the snow can be more easily removed from the travel surface.

If desired, a support plate can be located between the first and second axles for providing a backing to the conveyor as it traverses the surface being cleaned. The support plate preferably has a relatively horizontal surface or series of surfaces adjacent to the travel surface during operation of the snow removal apparatus. Preferably, the conveyor extends across the support plate and is held in position by the support plate when the snow removal apparatus is in contact with the surface being cleared. The support plate can provide a more evenly distributed downward force for the conveyor so that the conveyor is pressed against the snow-covered travel surface and more fully engages the snow thereon, rather than riding up and over the snow. Alternatives to the support plate include a series of rollers spaced between the first and second axles and positioned to hold the conveyor in operational engagement with the travel surface and the snow covering the travel surface.

Other features and advantages of the invention along with the organization and manner of operation thereof will become apparent to those skilled in the art upon review of the following detailed description, claims, and drawings, wherein like elements have like numerals throughout.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION

Figure 1:
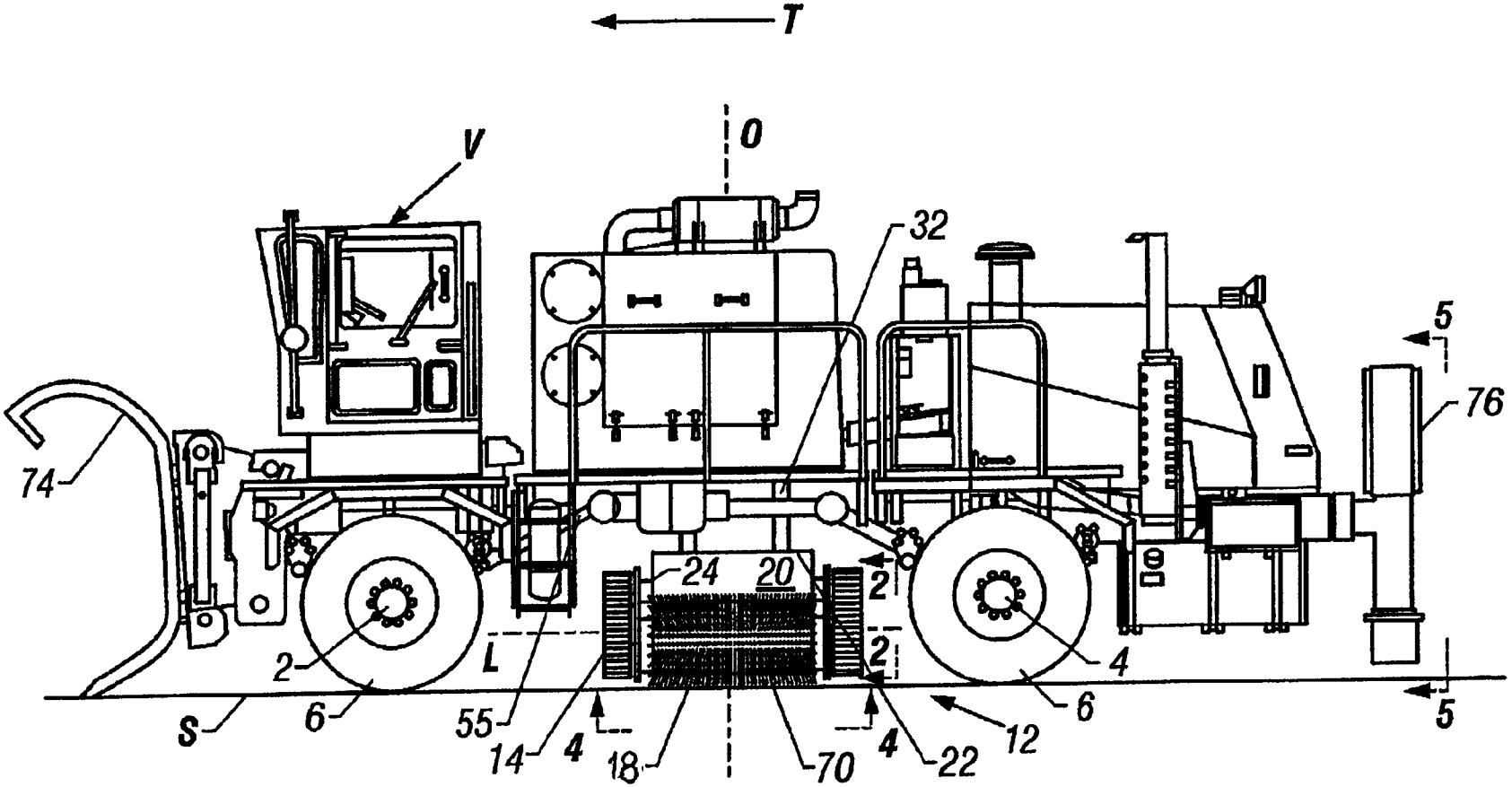
FIG. 1 is a side view of the snow removal apparatus according to a preferred embodiment of the present invention, shown coupled to a vehicle.

Preferred embodiments of the present invention are shown in the attached figures and are described herein and in the accompanying claims as being mounted on a vehicle V. Although the snow removal apparatus of the present invention can be mounted on any type of vehicle, the snow removal apparatus illustrated in the figures is shown mounted on a truck having an internal combustion engine. Accordingly, as used herein and in the appended claims, the term "vehicle" is intended to include any conventional vehicle V, such as for example trucks, tractors, skid loaders, garbage trucks, pick up trucks, sport utility vehicles, automobiles, and the like.

It should be noted that some embodiments of the present invention can be operated without a vehicle V and can be independently driven, pushed or pulled manually by an operator, mounted upon a trailer, towed behind or pushed ahead of a vehicle V, or mounted on wheels, tracks, treads, or skis and pushed or pulled by a vehicle V. Similarly, other vehicles V such as tracked vehicles, farm equipment, and the like can be used to push, pull, or tow the present invention. The present invention can also be self-propelled and can be supported on wheels, skis, tracks, treads, or the like.

In the following description, in the accompanying drawings, and in the appended claims, reference is made to a travel surface S. The term "travel surface" is intended to include any paved or unpaved surface used or intended to be used for human or vehicular traffic or use, including for example, roads, driveways, alleys, sidewalks, taxiways, runways, tarmacs, parking lots, bike trails, hiking trails, snowmobile trails, freeways, highways, railroad tracks, bridges, railroad crossings, ice-skating rinks, curbs, ski hills, ice-covered lakes and rivers, hiking trails, walking trails, bicycle trails, snowmobile trails, and athletic fields. The term "travel surface" therefore is intended to encompass any surface employed for travel, recreation, work, or any other use.

Similarly, while it is frequently desirable to remove all or nearly all of the accumulated snow from a travel surface S, it may in some circumstances be desirable to remove less than all of the snow from a travel surface S or to more evenly distribute snow about a travel surface S. For example, the present invention can be used to groom ski hills, ski runs, ski trails, snowmobile trails, and the like. Similarly, the present invention can be used to distribute man-made snow over a given area such as a ski hill. Because any snow movement necessarily involves the removal of some amount of snow from its original location, the term "snow removal" as used herein and in the appended claims includes redistribution of snow over an area, removal of all or nearly all of the snow from an area, and removal or redistribution of less than all of the snow over an area.

The travel surface S is described and shown in the attached figures as being horizontal or relatively horizontal.

However, the present invention can also be used to remove snow from surfaces that are not horizontal. For example, the present invention can be used to remove snow from hills, valleys, slopes, inclines, and the like. Additionally, the present invention can be used to simultaneously or substantially simultaneously remove snow from multiple surfaces having different elevations. For example, the present invention can be used to remove snow from a road and an adjacent curb or sidewalk, all of which can have different elevations and contours. Also, as used herein and in the appended claims, the term "snow" is meant to include man-made and naturally occurring snow, sleet, filly or partially-melted snow (e.g., slush), hailstones, ice, frozen rain, and the like.

Referring first to FIG. 1, the present invention is preferably coupled to a vehicle V, as mentioned above. The vehicle V shown in FIG. 1 is a truck with a front vehicle axle 2 and a rear vehicle axle 4 to which wheels 6 are attached. The snow removal apparatus 12 is preferably coupled to the vehicle V between the front and rear vehicle axles 2, 4. However, in alternative embodiments of the present invention, the snow removal apparatus 12 can be coupled to the vehicle V in front of the front axle 2 or behind the rear axle 4, can be towed behind the vehicle V or can be connected to and pushed in front of a vehicle V, can be mounted beside the vehicle V, or can be operated independently of a vehicle. Additionally, in some applications the snow removal apparatus 12 can be coupled to vehicles V with more than two axles. Also, the snow removal apparatus 12 can be coupled to or moved by vehicles V which do not have a front and/or a rear vehicle axle 2, 4. For example, the present invention can be used with tracked vehicles V.

It is highly desirable to mount the snow removal apparatus 12 between the front and rear vehicle axles 2, 4 so that the weight of the vehicle V can be better employed to counteract upward forces from the snow removal apparatus 12 during operation. This mounting location is also preferred because the vehicle weight can better reduce vibration and bouncing of the snow removal apparatus 12. This is particularly advantageous when either or both the snow removal apparatus 12 and the vehicle V are operated at high rates of speed. Additionally, in embodiments in which the snow removal apparatus 12 is coupled to the vehicle V between the front and rear vehicle axles 2, 4, the weight of the vehicle V can prevent the snow removal apparatus 12 from riding up and over the snow and can maintain the snow removal apparatus 12 in contact with the snow.

The vehicle V is preferably movable along the travel surface S in a travel direction T (represented by an arrow). It is contemplated that the travel direction T will change as the vehicle V turns, travels up or down inclines, or in some embodiments is moved in reverse. However, for clarity only, the travel direction T is shown in the attached figures and is described herein as being relatively straight and relatively level.

Figure 2:
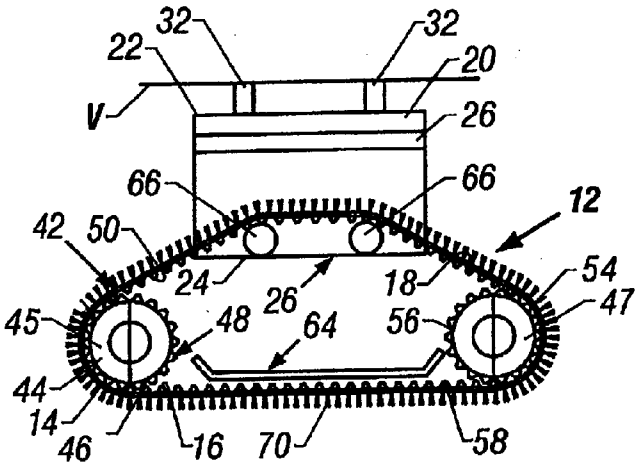
FIG. 2 is a front view of a portion of the snow removal apparatus shown in FIG. 1.
Figure 4:
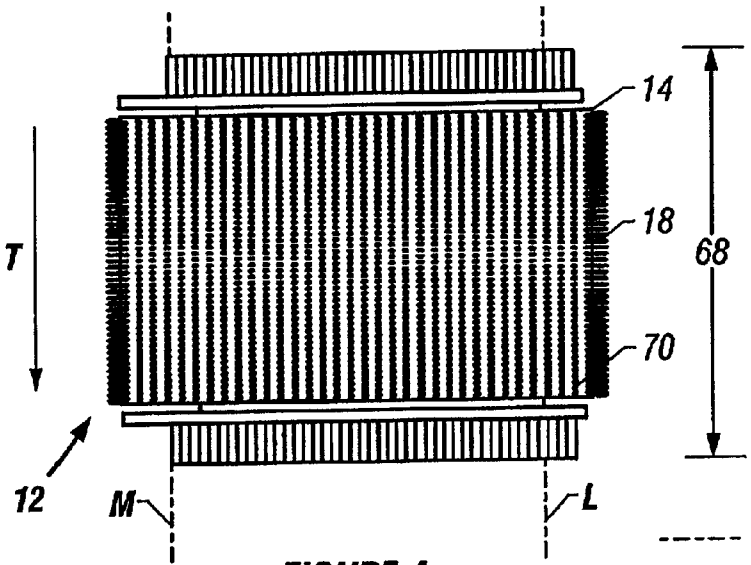
FIG. 4 is a bottom view of the snow removal apparatus shown in FIGS. 1–3.

Referring now to FIG. 2, some preferred embodiments of the snow removal apparatus 12 are preferably moveable along the travel surface S in the travel direction T (out of the plane of the page in FIG. 2) and are operable to remove snow from the travel surface S by driving a conveyor 14. In this regard, the conveyor 14 rotates about one or more axes L, M and contacts the travel surface S to move the snow laterally from the travel surface S with respect to the travel direction T. This lateral direction of snow removal can be in any direction at an angle with respect to the travel direction T. In the illustrated preferred embodiment for example, the snow removal apparatus 12 is shown oriented to throw snow in a direction that is generally perpendicular with respect to the travel direction T.

The conveyor 14 (described in greater detail below) is preferably driven about one or more axes L, M that are defined by rotating or non-rotating elements, thereby establishing a travel path for the conveyor 14 about the axes L, M. Preferably, the conveyor 14 passes about at least one rotating element (i.e., "wheel"). By way of example only, the illustrated preferred embodiment of the snow removal apparatus 12 shown in the figures travels about a number of elements. In this embodiment, the wheels take the form of sprockets 45 mounted upon one or more axles 44 at one end of the conveyor 14 and one or more sprockets 47 mounted upon one or more axles 54 at another end of the conveyor 14. The travel path of the conveyor 14 can be defined by the sprockets 45, 47 and axles 44, 54 alone, or can partially define the travel path of the conveyor 14. For example, the travel path of the conveyor 14 in the illustrated preferred embodiments is defined by the sprockets 45, 47 and axles 44, 54 and by drive shafts 66 (described in greater detail below).

In the illustrated preferred embodiments and as shown in FIGS. 1–4, the conveyor 14 is preferably immediately below the vehicle V and at a distance above the travel surfaces S and is preferably rotatable about the axes L, M. However, in alternative embodiments of the present invention the conveyor 14 can be positioned or oriented in different manners with respect to the vehicle V and the travel surface S. For example, the conveyor 14 can be rotatable about a single axis L. Alternatively, in other embodiments the conveyor 14 can be a roll or a brush which is rotatable about its own axis.

The conveyor 14 is preferably a loop-shaped element or structure made of one or more components. In some preferred embodiments of the present invention, the conveyor 14 is a belt. In other embodiments, the conveyor 14 can be a number of individual elements coupled or linked together in a loop, such as for example, a chain, a series of connected slats, bars, or rods, and the like. Preferably, the conveyor 14 has an inwardly-facing side 16 and an outwardly-facing side 18 (hereinafter referred to as "first" and "second" sides, respectively). During operation of the illustrated preferred embodiment, the conveyor 14 is rotated about elements defining first and second axes L, M as mentioned above, and at least a portion of the second side 18 of the conveyor 14 faces the travel surface S.

Figure 3:
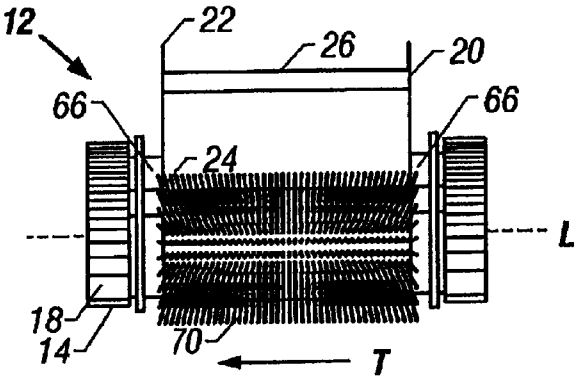
FIG. 3 is a side view of the snow removal apparatus shown in FIGS. 1 and 2.
Figure 5:
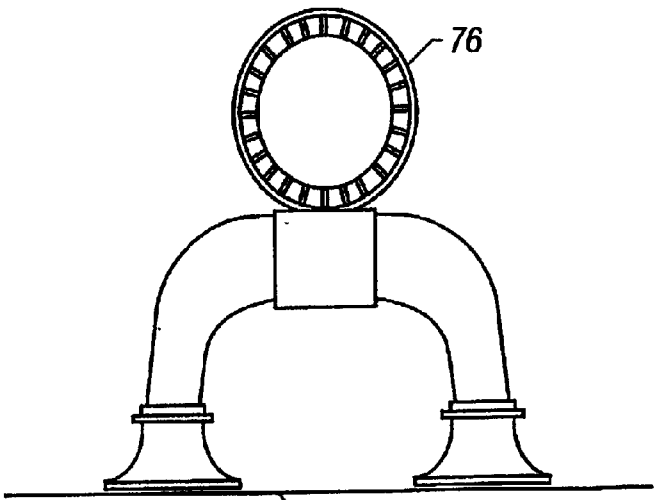
FIG. 5 is a front view of the blower shown in FIG. 1.

As shown in FIGS. 1–3, the present invention preferably includes a frame 20 which at least partially supports the conveyor 14 in operation and holds the conveyor 14 on the vehicle V. The frame 20 is preferably coupled to the vehicle V in order to position the snow removal apparatus 12 in any location with respect to the vehicle V as described above. For example, the frame 20 in the illustrated preferred embodiment is coupled to the vehicle V between the front and rear vehicle axles 2, 4.

While the configuration of the frame 20 is preferably at least partially determined by the particular vehicle V to which the snow removal apparatus 12 is coupled, the frame 20 preferably includes a portion that is connected to the vehicle V and a portion that is connected to the rest of the apparatus 12. In the apparatus illustrated in the figures, a first end 22 of the frame 20 is adjacent the vehicle V and a second end 24 of the frame 20 is connected to the other elements of the apparatus 12. Most preferably, the first end 22 of the frame 20 is coupled to a relatively low portion of the vehicle V so that the snow removal apparatus 12 is or can be positioned near the travel surface S. Additionally, the frame 20 of the snow removal apparatus 12 is mounted upon the vehicle V in a location in which the snow removal apparatus 12 does not interfere with the vehicle wheels 6.

The frame 20 of the snow removal apparatus 12 can be coupled to the vehicle V (as best seen in FIG. 1) in a number of different manners. In some embodiments, the frame 20 is connected to the vehicle V with frame fasteners (not shown), such as screws, bolts, or other threaded fasteners, pins, rivets, hooks, clamps, clasps, interlocking or mating elements (e.g., male and female connectors), and the like. Alternatively, the frame 20 can be coupled directly to the vehicle V without the use of frame fasteners. For example, the frame 20 can be welded to the vehicle V or can even be integrally formed with the vehicle V.

In some embodiments, the frame 20 of the snow removal apparatus 12 extends outwardly away from the vehicle V and toward the travel surface S so that the snow removal apparatus 12 can engage the travel surface S. However, in different embodiments of the present invention, the second end 24 of the frame 20 can extend in any number of directions away from the vehicle V, each one of which still positions the snow removal apparatus 12 in engagement with the travel surface S. For example, in some preferred embodiments, the second end 24 of the frame 20 extends to one side of the vehicle V. In such embodiments, the snow removal apparatus 12 is advantageously mounted on one side of the vehicle V so that the operator can see all or a portion of the snow removal apparatus 12 in operation. In this manner, the operator can navigate the snow removal apparatus 12 around obstructions and obstacles.

The frame 20 can take a number of different forms, each one of which is capable of supporting the various elements of the snow removal apparatus 12 (such as the sprockets 45, 47, axles 44, 54, and conveyor 14 in some preferred embodiments). The frame 20 can therefore be defined by rods, tubes, bars, angle irons and other framework, plates, sheets, and the like connected with fasteners, welds, or in any other conventional manner. In the illustrated preferred embodiment, the frame 20 preferably includes one or more support members 26 which provide the frame 20 with rigidity and stability. In different embodiments, different numbers and configurations of support members 26 can be used as dictated by a given application.

Preferably, the frame 20 and the support members 26 are made from steel, iron, aluminum, or other metal. However, in alternative embodiments, other materials can be used, such as plastics, polymers, urethane, nylon, and other synthetic materials, wood and other organic materials, ceramics, fiberglass, and composites. The frame 20 and the support members 26 can be coated or sealed with a protective material to prevent water, salt, sand, and other corrosive substances from damaging, rusting, or corroding the frame 20 and the support members 26. For example, the frame 20 and/or the support members 26 can be sealed or coated with paint, varnish, plastic or rubber coating, and the like.

In some preferred embodiments of the present invention, the snow removal apparatus 12 includes an elevator 32 (shown in FIGS. 1 and 2). The elevator 32 is preferably coupled to the vehicle V and the frame 20. With reference to the illustrated preferred embodiments, the elevator 32 is preferably coupled to the vehicle V between the front and rear vehicle axles 2, 4, although other locations of the elevator 32 are possible depending upon the desired location of the frame 20 and apparatus 12.

The elevator 32 is preferably operable to selectively raise and lower the snow removal apparatus 12 with respect to the travel surface S. In particular, the elevator 32 preferably allows an operator to raise the snow removal apparatus 12 in order to withdraw the snow removal apparatus 12 from the travel surface S, to place the snow removal apparatus 12 in a raised storage position, to transport the snow removal apparatus 12 in the storage position, to overcome an obstacle in the travel surface S, to adjust based upon different elevations of the travel surface S, and the like. An elevator 32 can also better facilitate repair of the vehicle V and of the snow removal apparatus 12 by allowing a mechanic or the operator to move the snow removal apparatus 12 into different positions, thereby allowing the mechanic or the operator greater access to various areas of the vehicle V and the snow removal apparatus 12.

The elevator 32 preferably has at least two positions, including an elevator first position (see FIG. 1) and an elevator second position. As shown in FIG. 1, when the elevator 32 is in the elevator first position, the snow removal apparatus 12 is preferably adjacent to the travel surface S. In the elevator first position, the snow removal apparatus 12 can contact the travel surface S and snow thereon for purposes of snow removal. When desired, the elevator 32 can be moved into the elevator second position so that the snow removal apparatus 12 is lifted a distance from the travel surface S. In this manner, the snow removal apparatus 12 can be more easily transported to another location. Similarly, the elevator 32 can be moved into the elevator second position during operation to overcome or to better traverse obstacles located along the path of the snow removal apparatus 12.

In some cases, the elevator 32 can be used to facilitate or to better enable removal and/or attachment of the snow removal apparatus 12 with respect to the vehicle V. For example, the elevator 32 can be positioned above the snow removal apparatus 12 and, following its manual or automatic attachment to the snow removal apparatus 12, can be used to lift the snow removal apparatus 12 off of the travel surface S. As another example, the elevator 32 can be used to lower the snow removal apparatus 12 to the travel surface S for removal of the snow removal apparatus 12 from the vehicle V. In this regard, the lowered snow removal apparatus 12 can be easier to disconnect and remove from the elevator 32 and vehicle V. This is particularly desirable in applications in which the vehicle V is used for operations other than for snow removal. For example, it can be desirable to disconnect and remove the snow removal apparatus 12 from a vehicle V during non-winter months. Similarly, because some embodiments of the snow removal apparatus 12 can be relatively bulky and heavy, the elevator 32 can be used to assist in lifting and installation of the snow removal apparatus 12.

The elevator 32 preferably includes one or more lifting devices (not shown). The lifting devices can be electric or hydraulic motors, (e.g., driving a pinion of a rack and pinion assembly connected to the frame 20, driving a drum, pulley, shaft, or other element about which one or more cables connected to the frame 20 can be wound and unwound to raise and lower the apparatus 12, and the like), pneumatic or hydraulic cylinders, solenoids, or any other driving device. Alternatively, the elevator 32 can be powered in a conventional manner by a power take-off from the engine or motor of the vehicle V. The lifting devices are preferably coupled to the frame 20 and to the vehicle V so that the lifting devices can selectively raise and lower the snow removal apparatus 12. Most preferably, the elevator 32 and the lifting devices can be operated by a conventional controller (not shown) connected to the lifting devices. Alternatively, the elevator 32 can be manually operated, such as by one or more user-operable buttons, dials, levers, switches, or other controls (in the vehicle V, on the outside of the vehicle V, or on the elevator 32) by a user-manipulatable crank, wheel, or jack connected to the elevator 32, and the like.

Referring now to FIG. 2, the conveyor 14 is preferably rotated about one or more elements which preferably support and guide the conveyor 14. As mentioned above, any number of these rotatable or non-rotatable elements can be employed, depending at least partially upon the desired path of the conveyor 14 as it is driven. In the illustrated preferred embodiment for example, the conveyor 14 is preferably driven about multiple elements, including rotating elements (wheels). In this embodiment, the wheels take the form of one or more sprockets 45 mounted upon one or more axles 44 at one end of the conveyor 14 and one or more sprockets 47 mounted upon one or more axles 54 at another end of the conveyor 14. In some embodiments, a single sprocket 45, 47 can be mounted for rotation at the opposite ends of the conveyor 14. In other embodiments (such as the illustrated preferred embodiment), two or more sprockets 45, 47 are mounted for rotation at the opposite ends of the conveyor 14. Only one of each sprocket 45, 47 are visible in FIG. 2. When multiple sprockets 45, 47 are at each end of the conveyor 14, the sprockets 45, 47 at each end are preferably mounted upon a common shaft or axle 44, 54 for rotation therewith or rotation thereabout. Alternatively, some or all of the sprockets 45, 47 can be mounted upon dedicated axles 44, 54. Although not required, the sprockets 45, 47 at each end of the conveyor 14 can share a common axis L, M or can be substantially aligned along a common axis L, M.

The conveyor 14 can be driven in a number of conventional manners, such as by one or more sprockets, drums, shafts, or other rotating elements drivably engaged with the conveyor 14. Such driving elements can be any of the elements defining the path of the conveyor 14 as mentioned above, or can be separate elements driving the conveyor 14 from within or outside of the loop defined by the conveyor 14. Together, the driving elements and the rotatable and non-rotatable elements guiding the conveyor 14 through its path define a drive mechanism 42 of the conveyor 14. In some embodiments of the present invention, the conveyor 14 can be driven in forward and reverse directions, while in other embodiments the conveyor 14 can be driven only in one direction. For example, the conveyor 14 in FIG. 2 can preferably be driven clockwise or counterclockwise about the sprockets 45, 47 depending upon the direction in which the axles 44, 54 are driven. Preferably, the axles 44, 54 can be driven in either direction as selected by a user. This capability enables the user to convey snow to the left or right of the vehicle V by controlling the direction of rotation of the conveyor 14.

With reference to the embodiments shown in the figures, the drive mechanism 42 includes the first and second axles 44, 54 about which the conveyor 14 is driven. In these embodiments, the axles 44, 54 are preferably coaxial with the axes L, M, and carry the sprockets 45, 47 (which are also a part of the drive mechanism 42). Preferably, the conveyor 14, sprockets 45, 47, and axles 44, 54 are driven by one or more drive shafts 66, which are in turn driven in any conventional manner. For example, the drive shafts 66 can be driven by a separate motor or engine or by connection to a power takeoff from the engine or motor (or drive shaft thereof) of the vehicle V. In the illustrated preferred embodiment for example, either or both of the drive shafts 66 are drivably connected to the drive shaft 55 of the vehicle V. This connection can be made in a number of different manners well-known to those skilled in the art, such as by one or more chains passed about sprockets on either or both drive shafts 66 and the vehicle drive shaft 55, by one or more belts passed about pulleys, drums, or similar elements on either or both drive shafts 66 and the vehicle drive shaft 55, by meshing gears on either or both drive shafts 66 and the vehicle drive shaft 55, and in still other manners.

Either or both drive shafts 66 are preferably drivably engaged with the conveyor 14 via teeth or sprockets (not shown) on the drive shafts 66. Alternatively, either or both of the drive shafts 66 can frictionally engage the inwardly-facing side 16 of the conveyor 14 in order to drive the conveyor 14. Still other manners of driving the conveyor 14 via the drive shaft(s) 66 are possible, each one of which falls within the spirit and scope of the present invention. If driven by the drive shaft(s) 66, the sprockets 45, 47 and the axles 44, 54 can be non-powered, and are therefore turned by movement of the conveyor 14.

In other embodiments of the present invention, either or both of the axles 44, 54 can be drivably connected to a motor, engine, or power takeoff of the vehicle V in any of the manners described above in order to drive the conveyor 14. In such cases, the drive shafts 66 can be idler shafts or wheels that are driven by movement of the conveyor 14.

Whether driven by the conveyor 14 (as in the illustrated preferred embodiment) or powered to drive the conveyor 14, the sprockets 45, 47 preferably engage and rotate with the conveyor 14. This engagement can take a number of different forms well known to those skilled in the art of track-type vehicles, including without limitation apertures 50 in the conveyor 14 in which the teeth of the sprockets 45, 47 are received as the sprockets 45, 47 turn, grooves or recesses (not shown) in the conveyor 14 used for the same purpose, and the like.

Although the conveyor 14 is preferably driven about sprockets 45, 47 on axles 44, 54 as just described, it should be noted that the conveyor 14 can take a number of different forms adapted to be driven about a number of different elements well known to those skilled in the art. Any other type of wheel can be employed about which the conveyor 14 can pass (whether driven by the conveyor 14 or driving the conveyor 14). By way of example only, the conveyor 14 can be passed about pulleys, shafts, drums, or other rotatable elements which engage the conveyor 14 with teeth, fingers, bumps, or other protrusions. Alternatively or in addition, the conveyor 14 can have teeth, fingers, bumps, or other protrusions which engage with the pulleys, shafts, drums, or other rotatable elements. In either case, the teeth, fingers, bumps, or other protrusions can mate with holes, grooves, slots, dimples, recesses, or other apertures to provide a mating engagement between the rotatable elements and the conveyor 14. However, in some embodiments, a flat interface between the rotatable elements and the conveyor 14 can provide frictional engagement between the rotatable elements and the conveyor 14 without such mating engagement.

One having ordinary skill in the art will appreciate that still other alternatives exist to the use of sprockets 45, 47 and axles 44, 54 in order to guide the conveyor 14 in its path of motion. Each of these alternatives falls within the spirit and scope of the present invention. By way of example only, the conveyor 14 can be driven about one or more non-rotating elements, such as bars, shafts, struts, or plates (whether provided with wear elements or not). The sprockets 45, 47, drive shafts 66, or other elements about which the conveyor 14 is passed can also be positioned to maintain a desired tension on the conveyor 14.

In some preferred embodiments of the present invention, a support plate 64 (partially shown in FIG. 2) is located between the first and second axles 44, 54 relatively near the travel surface S. The support plate 64 is preferably a single continuous element with a surface adjacent to the travel surface S. The first side 16 of the conveyor 14 preferably extends across the support plate 64. The support plate 64 can be positioned with respect to the conveyor 14 to continuously contact the conveyor 14 or to contact the conveyor 14 only when the conveyor 14 rides atop the travel surface S or snow upon the travel surface S. In either case, the support plate 64 preferably acts as a backing for the conveyor 14 in order to more firmly engage the travel surface S and snow thereon. Preferably, the support plate 64 provides a relatively evenly distributed downward force to the conveyor 14, pressing the conveyor 14 against the snow covered travel surface S and engaging the snow. In this manner, the conveyor 14 can preferably engage the snow-covered travel surface S rather than riding up and over the snow. Additionally, the support plate 64 can be positioned to apply a force to the conveyor 14 to maintain tension on the conveyor 14.

A number of other structures can be employed to provide the above-described support to the conveyor 14 and to generate improved conveyor 14 engagement with the travel surface S and snow thereon. These structures include a series of rods, bars, or other elements defining a framework adjacent to the conveyor 14. In other embodiments, a series of rollers (not shown) can be positioned between the first and second axles 44, 54 to provide conveyor support.

Preferably, the conveyor 14 is provided with a number of bristles 70 extending away from the second side 18 of the conveyor 14. In this manner, the bristles 70 can be dragged through snow by the conveyor 14, can drag a quantity of snow from the travel surface S to one side of the snow removal apparatus 12, and can release the snow, throwing the snow away from the travel surface 12. The bristles 70 can be in any or no pattern across the conveyor 14, and are preferably distributed relatively evenly across the second side 18 of the conveyor 14. In some highly preferred embodiments, the bristles 70 are arranged in rows across the conveyor 14 as shown in the figures.

In other highly preferred embodiment of the present invention, paddles (not shown) can be connected to the second side 18 of the conveyor 14 in any manner or can be integral with the conveyor 14, and preferably extend at any angle away from the conveyor 14 to selectively engage the travel surface S and any snow covering the travel surface S. In addition, the paddles are preferably spaced relatively evenly across the second side 18 of the conveyor 14. Most preferably, the paddles include substantially horizontal surfaces which are substantially perpendicular to the travel direction T. In this manner, the paddles can engage the snow and can operate with the conveyor 14 to remove the snow from the travel surface S.

In some embodiments, (e.g., see FIG. 1) the snow removal apparatus 12 is coupled to a vehicle V that also has a snowplow 74. In such embodiments, the snowplow 74 can be coupled to the front, side, underside, or rear of the vehicle V, and the conveyor 14 can be coupled to the vehicle V in any of the locations described above. In some highly preferred embodiments, the snowplow 74 is located in front of the vehicle V and the snow removal apparatus 12 is located between the axles 2, 4 of the vehicle V as described above. Although the snowplow 74 can have any position on the vehicle V with respect to the snow removal apparatus 12, the snowplow 74 is located ahead of the snow removal apparatus 12 in some highly preferred embodiments. In operation, the snowplow 74 preferably removes snow from the travel surface S and pushes the snow to one or to both sides of the vehicle V. Additionally, the snowplow 74 can remove or loosen any compacted snow spread across the travel surface S. The conveyor 14 is preferably driven as described above, engages snow which the snowplow 74 failed to remove from the travel surface S, and throws the snow from the travel surface S.

In other preferred embodiments of the present invention, the snowplow 74 is coupled to one side of the vehicle V or between the wheels 6 of the vehicle V. In such embodiments, the snow removal apparatus 12 can be located anywhere on the vehicle V. For example, the snow removal apparatus 12 can also be located between the wheels 6, such as in a location ahead of the snowplow 74. In this arrangement, the conveyor 14 can remove snow from the travel surface S and can throw the snow to one side of the vehicle V. The snowplow 74 can then direct the snow farther away from the travel surface S, thereby effectively widening the area of the travel surface S which the snow removal apparatus 12 can clear in a single pass.

As shown in FIG. 1, the snow removal apparatus 12 can include a blower 76. The blower 76 is preferably coupled to or mounted upon the vehicle V in any conventional manner. As shown in FIG. 1, the blower 76 can be coupled to the back of the vehicle V. In alternative embodiments of the present invention, the blower 76 can be coupled to the vehicle V in any number of other locations, such as for example, the front of the vehicle V, one side of the vehicle V, or the underside of the vehicle V.

In operation, the blower 76 preferably blows snow off of the travel surface S by blowing a fluid such as air, oxygen, a de-icing solution, and the like onto the travel surface S. In some embodiments, the fluid contacts the travel surface S and the snow covering the travel surface S with sufficient force to force snow off of the travel surface S. The blower 76 can be used in conjunction with the snow removal apparatus 12 of the present invention, and in this regard can be located in any position on the vehicle V relative to the snow removal apparatus 12. However, the snow removal apparatus 12 is located ahead of the blower 76 in some highly preferred embodiments. In such embodiments, the conveyor 14 preferably removes most of the snow from the travel surface S, while the blower 76 preferably blows at least some of the remaining snow off of the travel surface S. In other embodiments, the blower 76 can be positioned in front of the conveyor 14 so that the blower 76 blows snow off of the travel surface S and the conveyor 14 removes at least some of the remaining snow from the travel surface S.

In some embodiments of the present invention, the blower 76 has a heater and can therefore blow heated fluids onto the travel surface S. In this manner, the blower 76 can preferably loosen compacted snow and/or can melt the snow.

As shown in the figures, the vehicle V to which the snow removal apparatus 12 is mounted can have a snowplow 74 as well as a blower 76, and in some cases can have multiple snow plows 74 and blowers 76 located in various positions on the vehicle V. In the illustrated preferred embodiment for example, a snowplow 74 is coupled to the front of the vehicle V, the snow removal apparatus 12 is coupled to the vehicle V between the wheels 6, and the blower 76 is coupled to the rear of the vehicle V. Alternatively, the conveyor 14, the snowplow 74, and the blower 76 can be coupled to the vehicle V in any number of different manners and orientations.

Although the snow removal apparatus 12 of the present invention can be rigidly and non-movably mounted to the vehicle V to throw snow perpendicular to the travel direction T, in some preferred embodiments the snow removal apparatus 12 is rotatable with respect to vehicle V and the travel direction T. Most preferably in such embodiments, the frame 20 is pivotable about a vertical or substantially vertical axis O (see FIG. 1) to pivot the conveyor 14 with respect to the travel direction T. In this manner, the conveyor 14 can be pivoted with respect to the vehicle V to throw snow selectively at different angles with respect to the travel direction T. In these embodiments rotational force is preferably transmitted to the snow removal apparatus 12 and preferably to the drive shafts 66 from the vehicle drive shaft 55 by mechanical linkages which can include ball and socket joints, flexible elbow linkages, and the like.

Figure 6:
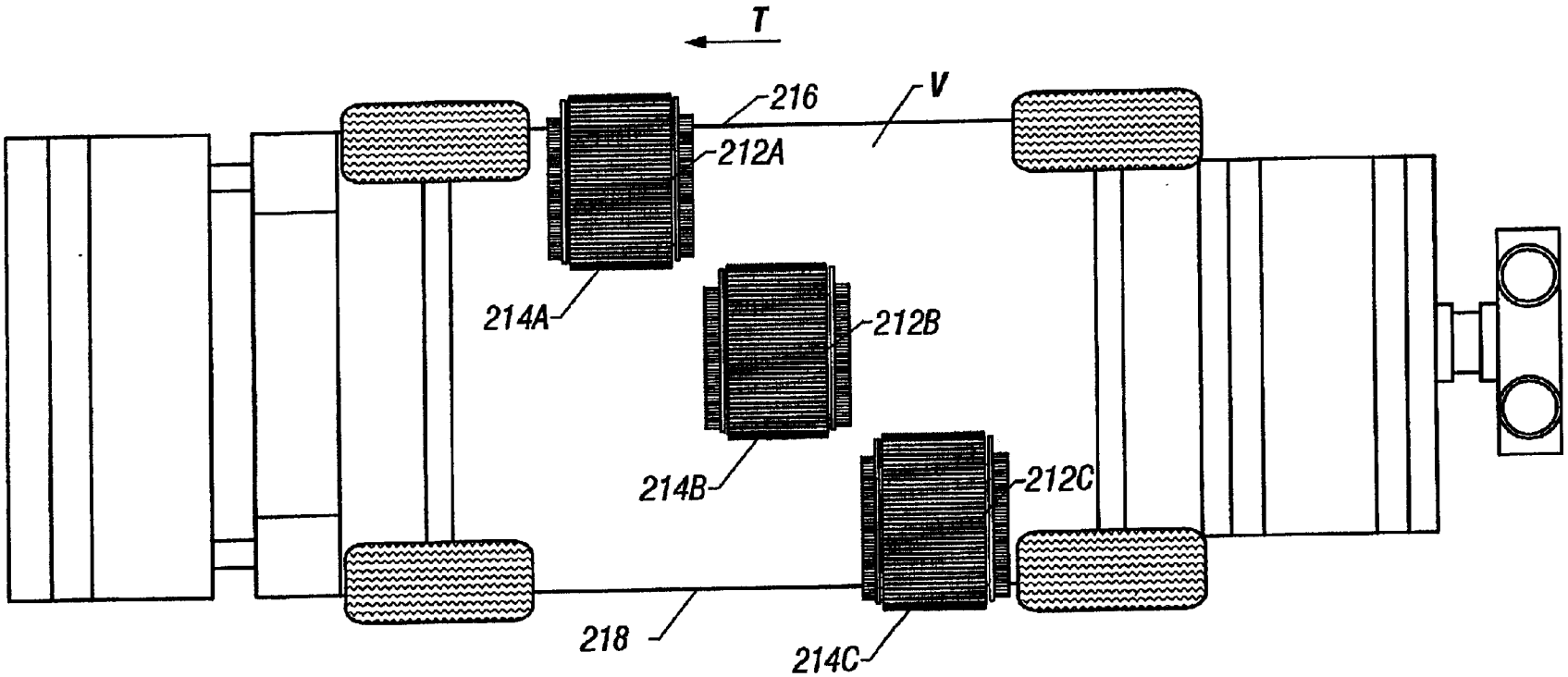
FIG. 6 is a bottom view of the snow removal apparatus according to a second preferred embodiment of the present invention, shown coupled to a vehicle.
Figure 7:
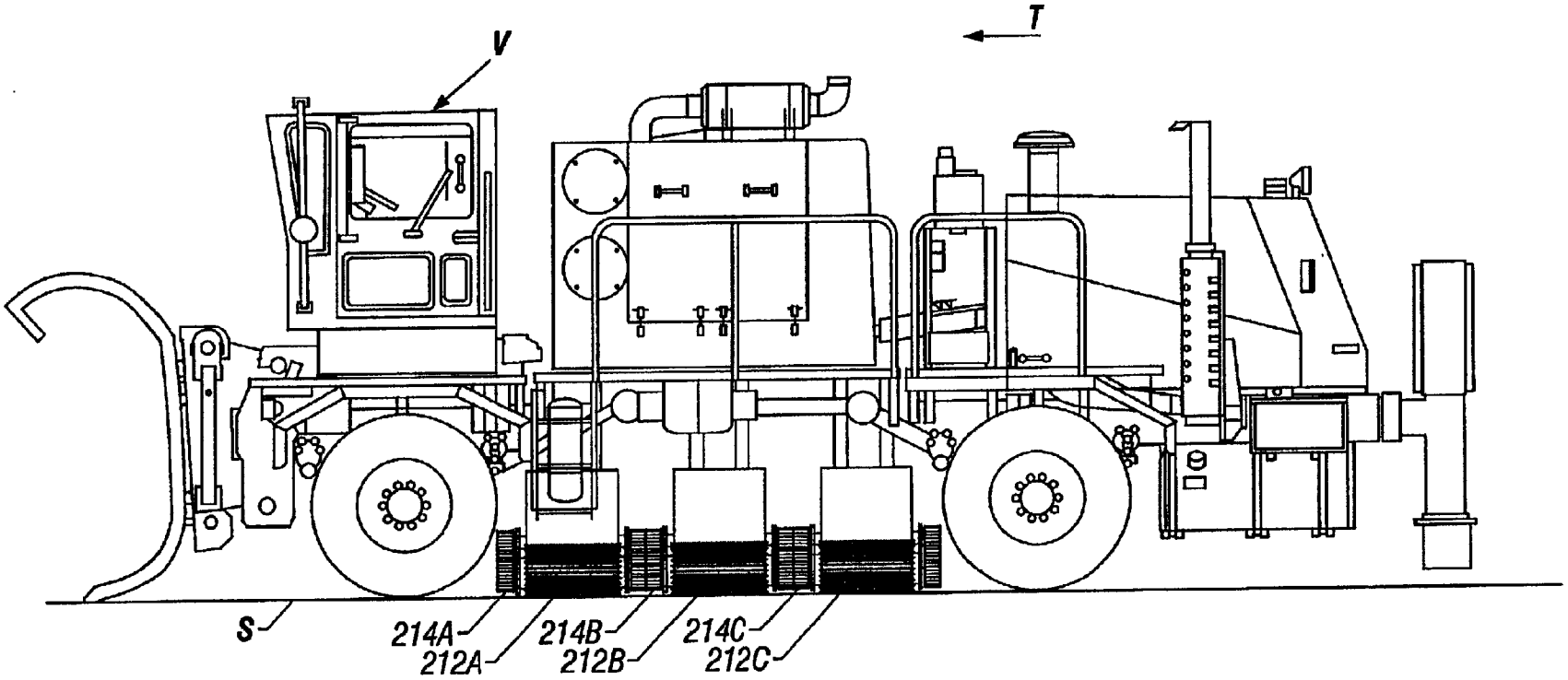
FIG. 7 is a side view of the snow removal apparatus shown in FIG. 6.

Referring now to FIGS. 6 and 7, some embodiments of the present invention employ multiple snow removal apparatuses 212 that act independently or in cooperation with one another to remove snow from a travel surface S. In such embodiments, two or more snow removal apparatuses 212 are preferably moveable along the travel surface S in the travel direction T and are operable to remove snow from the travel surface S by rotating respective conveyors 214 in any of the manners described above. The conveyors 214 are driven to remove snow from the travel surface S and to throw the snow at an angle relative to the travel direction T.

As mentioned above with respect to the earlier-described embodiments, the snow removal apparatuses 212 are preferably coupled to the underside of the vehicle V for travel with the vehicle V along the travel surface S in the travel direction T. However, the snow removal apparatuses 212 can each be located on a vehicle V in any of the other manners described above.

In the embodiment illustrated in FIGS. 6 and 7, a first snow removal apparatus 212A is positioned relatively near a first side 216 of the vehicle V, a second snow removal apparatus 212B is adjacent the first snow removal apparatus 212A, and a third snow removal apparatus 212C is positioned relatively near a second side 218 of the vehicle V and on the other side of the second snow removal apparatus 212B. The first, second, and third snow removal apparatuses 212A, 212B, 212C include first, second, and third conveyors 214A, 214B, 214C, respectively. In the embodiment illustrated in FIG. 6, the first, second, and third conveyors 214A, 214B, 214C are rotatable about their own axes to throw snow to the second side 218 of the vehicle V. However, in other embodiments, the conveyors 214A, 214B, 214C can be arranged and/or can rotate with respect to the vehicle to throw snow in other manners. In such embodiments, the conveyors 214A, 214B, 214C can be rotatable in different directions as appropriate to remove snow from beneath the vehicle V as the vehicle V moves.

By way of example only, the first conveyor 214A illustrated in FIG. 6 can be rotatable in one direction to throw snow to one side 216 of the vehicle V, while the other two conveyors 214B, 214C can be rotatable in an opposite direction to throw snow to the other side 218 of the vehicle V. As another example, the first and third conveyors 214A, 214C can be placed on opposite sides of the vehicle V (opposite to their locations shown in FIG. 6), and in such an arrangement can be rotated with the second conveyor 214B in an opposite direction to throw snow to the first side 216 of the vehicle V. Still other arrangements and rotational directions of the conveyors 214A, 214B, 214C are possible and fall within the spirit and scope of the present invention.

The first, second, and third snow removal apparatuses 212A, 212B, 212C are preferably substantially similar in construction and operation to the snow removal apparatus 12 described above and shown in FIGS. 1–5. Also, in alternative embodiments, the first, second, and third snow removal apparatuses 212A, 212B, 212C can include any one or more of the alternative embodiments described above with respect to the snow removal apparatus 12.

As shown in FIGS. 6 and 7, in some highly preferred embodiments of the present invention, the first apparatus 212A is positioned relatively near the first side 216 of the vehicle V, the second apparatus 212B is positioned to one side and spaced a distance behind the first apparatus 212A, and the third apparatus 212C is positioned near the second apparatus 212B and the second side 218 of the vehicle V and at a second distance behind the second apparatus 212C. In such embodiments, the first conveyor 214A is preferably driven to throw snow toward the center of the vehicle V. The second conveyor 214B is preferably driven to remove snow from the travel surface S and to throw the snow to the second side 218 of the vehicle V. The third conveyor 214C preferably removes snow from the travel surface S and directs this snow to the second side 218 of the vehicle V. In this arrangement, the first conveyor 214A preferably removes snow from the travel surface S and throws the snow laterally in front of the second conveyor 214B. The second conveyor 214B removes snow from the travel surface S and throws this snow, together with the snow from the first conveyor 214A, in front of the third conveyor 212C. The third conveyor 212C removes snow from the travel surface S and throws this snow, together with the snow from the first and second conveyors 214A, 214B, laterally away from the second side 218 of the vehicle V. This arrangement of the first, second, and third conveyors 214A, 214B, 214C is useful for many purposes, including when the vehicle V is moved along the travel surface S at relatively high speeds and in cases where the vehicle V is relatively wide with respect to the length of the conveyors 214A, 214B, 214C.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims.

For example, the present invention is described herein as being used to remove snow. However, one having ordinary skill in the art would appreciate that the present invention could also be used to remove other substances from travel surfaces, such as for example dust, debris, garbage, sand, salt, yard waste, animal waste, water, sewage, and the like.

As such, the functions of the various elements and assemblies of the present invention can be changed to a significant degree without departing from the spirit and scope of the present invention.

What is claimed is:

1. A snow removal system for use with a vehicle to remove snow from a surface, the vehicle moveable along the surface in a travel direction and having an underside, the snow removal system comprising:

at least two frames coupled to the vehicle; and at least one conveyor coupled to each frame, each conveyor positioned to move snow from the surface at an angle with respect to the travel direction; and a prime mover rotatably coupled to each conveyor to drive the conveyor;

wherein the conveyors are rotatable to convey snow from beneath the vehicle, at least one of the conveyors oriented to direct snow laterally toward another of the conveyors; and wherein at least one of the conveyors is located laterally and ahead of another of the conveyors with respect to the travel direction.

2. The snow removal system of claim 1, wherein each conveyor is a belt.

3. The snow removal system of claim 1, further comprising bristles extending from each conveyor.

4. The snow removal system of claim 1, wherein at least two conveyors are oriented to direct snow laterally in different directions with respect to the travel direction.

5. A snow removal apparatus for use with a vehicle to remove snow from a surface as the vehicle moves along the surface in a travel direction, to snow removal apparatus comprising:

a frame moveable along the surface;

a first axle rotatably coupled to the frame;

a second axle rotatably coupled to the frame;

a support plate positioned between the two axles;

a first conveyor belt extending at least partially about the first and second axles and rotatable about the axles to convey snow from beneath the vehicle in a direction disposed at an angle with respect to the travel direction of the vehicle, the first conveyor belt moveable between the support plate and the surface, the support plate positioned adjacent to the first conveyor belt to retain at least part of the first conveyor belt adjacent the surface beneath the vehicle;

a second conveyor belt rotatable to convey snow from beneath the vehicle, at leant one of the first and second conveyor belts oriented to direct snow laterally toward another of the first and second conveyors belts; and a blower coupled to the vehicle, wherein the blower is directed at the surface to direct fluid onto the surface, the blower and snow removal apparatus operable to cooperatively remove snow from the surface in movement of the vehicle.

6. The snow removal apparatus of claim 5, further comprising bristles extending from the first conveyor belt.

7. The snow removal apparatus of claim 5, further comprising an elevator coupled to the frame and operable to lift and lower the frame with respect to the vehicle.

8. The snow removal apparatus of claim 5, wherein the first conveyor belt is located between a front axle and rear axle of the vehicle.

9. The snow removal apparatus of claim 5, further comprising a snowplow coupled to the vehicle, the snowplow and snow removal apparatus operable to cooperatively remove snow from the surface in movement of the vehicle.

10. The snow removal apparatus of claim 5, for use in a vehicle having an underside, wherein the first and second conveyor belts are coupled to respective frames, at least one of the first and second conveyors belts being located laterally and ahead of another of the first and second conveyors belts with respect to the travel direction.

11. A snow removal apparatus for use with a vehicle to remove snow from a surface as the vehicle moves along the surface in a travel direction, the snow removal apparatus comprising:

a frame moveable along the surface;

a first axle rotatably coupled to the frame;

a second axle rotatably coupled to the frame;

a support plate positioned between the two axles;

a first conveyor belt extending at least partially about the first and second axles and rotatable about the axles to convey snow from beneath the vehicle in a direction disposed at an angle with respect to the travel direction of the vehicle, the first conveyor belt moveable between the support plate and the surface, the support plate positioned adjacent to the first conveyor belt to retain at least part of the first conveyor belt adjacent the surface beneath the vehicle; and a second conveyor belt, wherein the first and second conveyor belts arc coupled to respective frames, at least one of the first and second conveyor belts being located laterally and ahead of another of the first and second conveyor belts with respect to the travel direction.

12. The snow removal apparatus of claim 11, further comprising bristles extending from the first conveyor belt.

13. The snow removal apparatus of claim 11, further comprising an elevator coupled to the frame and operable to lift and lower the frame with respect to the vehicle.

14. The snow removal apparatus of claim 11, further comprising a blower coupled to the vehicle, wherein the blower is directed at the surface to direct fluid onto the surface, the blower and snow removal apparatus operable to cooperatively remove snow from the surface in movement of the vehicle.

15. The snow removal apparatus of claim 11, wherein the first conveyor belt is located between a front axle and rear axle of the vehicle.

16. The snow removal apparatus of claim 11, further comprising a snowplow coupled to the vehicle, the snowplow and snow removal apparatus operable to cooperatively remove snow from the surface in movement of the vehicle.

17. The snow removal apparatus of claim 11, wherein the second conveyor belt is rotatable to convey snow from beneath the vehicle, at least one of the first and second conveyor belts oriented to direct snow laterally toward another of the first and second conveyors belts.

18. A snow removal apparatus for use with a vehicle to remove snow from a surface as the vehicle moves along the surface in a travel direction, the snow removal apparatus comprising:

a frame moveable along the surface;

a first axle rotatably coupled to the frame;

a second axle rotatably coupled to the frame;

a support plate positioned between the two axles;

a first conveyor belt extending at least partially about the first and second axles and rotatable about the axles to convey snow from beneath the vehicle in a direction disposed at an angle with respect to the travel direction of the vehicle, the first conveyor belt moveable between the support plate and the surface, the support plate positioned adjacent to the first conveyor belt to retain at least part of the first conveyor belt adjacent the surface beneath the vehicle; and a second conveyor belt rotatable to convey snow from beneath the vehicle, at lent one of the first and second conveyor bolts oriented to direct snow laterally toward another of the first and second conveyors belts;

wherein the first conveyor belt is located between a front axle and rear axle of the vehicle.

19. The snow removal apparatus of claim 18, further comprising bristles extending from the first conveyor belt.

20. The snow removal apparatus of claim 18, further comprising an elevator coupled to the frame and operable to lift and lower the frame with respect to the vehicle.

21. The snow removal apparatus of claim 18, further comprising a blower coupled to the vehicle, wherein the blower is directed at the surface to direct fluid onto the surface, the blower and snow removal apparatus operable to cooperatively remove snow from the surface in movement of the vehicle.

22. The snow removal apparatus of claim 18, further comprising a snowplow coupled to the vehicle, the snowplow and snow removal apparatus operable to cooperatively remove snow from the surface in movement of the vehicle.

23. The snow removal apparatus of claim 18, for use in a vehicle having an underside, wherein the first and second conveyor belts are coupled to respective frame at least one of the first and second conveyor belts being located laterally and ahead of another of the first and second conveyor belts with respect to the travel direction.

24. A snow removal apparatus for use with a vehicle to remove snow from a surface as the vehicle moves along the surface in a travel direction, the vehicle having an underside, the snow removal apparatus comprising:

a frame moveable along the surface;

a first ale rotatably coupled to the frame;

a second axle rotatably coupled to the frame;

a support plate positioned between the two axles;

a first conveyor belt extending at least partially about the first and second axles and rotatable about the axles to convey snow from beneath the vehicle in a direction disposed at an angle with respect to the travel direction of the vehicle, the first conveyor belt moveable between the support plate and the surface, the support plate positioned adjacent to the first conveyor belt to retain at least part of the first conveyor belt adjacent the surface beneath the vehicle; and a second conveyor belt rotatable to convoy snow from beneath the vehicle, at lent one of the first and second conveyor belts oriented to direct snow laterally toward another of the first and second conveyors belts;

wherein the first and second conveyor belts are coupled to respective frames, at least one of the first and second conveyor belts being located laterally and ahead of another of the first and second conveyor belts with respect to the travel direction.

25. The snow removal apparatus of claim 24, further comprising bristles extending from the first conveyor belt.

26. The snow removal apparatus of claim 24, further comprising an elevator coupled to the frame and operable to lift and lower the frame with respect to the vehicle.

27. The snow removal apparatus of claim 24, further comprising a blower coupled to the vehicle, wherein the blower is directed at the surface to direct fluid onto the surface, the blower and snow removal apparatus operable to cooperatively remove snow from the surface in movement of the vehicle.

28. The snow removal apparatus of claim 24, wherein the first conveyor belt is located between a front axle and rear axle of the vehicle.

29. The snow removal apparatus of claim 24, further comprising a snowplow coupled to the vehicle, the snowplow and snow removal apparatus operable to cooperatively remove snow from the surface in movement of the vehicle.

* * * * *